US011608152B2

(12) United States Patent
Lammers-Meis et al.

(10) Patent No.: US 11,608,152 B2
(45) Date of Patent: Mar. 21, 2023

(54) BOAT STEERING AND PROPULSION SYSTEM

(71) Applicant: Garmin Switzerland GmbH, Schaffhausen (CH)

(72) Inventors: David F. Lammers-Meis, Overland Park, KS (US); Jason D. Howe, Olathe, KS (US)

(73) Assignee: Garmin Switzerland GmbH

( * ) Notice: Subject to any disclaimer, the term of this patent is extended or adjusted under 35 U.S.C. 154(b) by 0 days.

(21) Appl. No.: 17/569,968

(22) Filed: Jan. 6, 2022

(65) Prior Publication Data

US 2022/0126966 A1 Apr. 28, 2022

Related U.S. Application Data

(63) Continuation of application No. 16/782,734, filed on Feb. 5, 2020, now Pat. No. 11,247,764.

(60) Provisional application No. 62/801,472, filed on Feb. 5, 2019.

(51) Int. Cl.

| | |
|---|---|
| ***B63H 21/17*** | (2006.01) |
| ***B63B 34/20*** | (2020.01) |
| ***B63H 25/52*** | (2006.01) |
| ***B63H 25/02*** | (2006.01) |
| *B63B 34/26* | (2020.01) |

(52) U.S. Cl.

CPC ..... *B63H 21/17* (2013.01); *B63B 34/20* (2020.02); *B63H 25/02* (2013.01); *B63H 25/52* (2013.01); *B63B 34/26* (2020.02)

(58) Field of Classification Search

CPC ..... B63H 21/17; B63H 25/52; B63H 25/02; B63B 34/20; B63B 34/26

See application file for complete search history.

(56) References Cited

U.S. PATENT DOCUMENTS 4,382,574 A * 5/1983 Ellestad ..... B63H 20/06 248/641
4,688,994 A * 8/1987 Gongwer ..... B63H 1/36 416/74
5,131,875 A * 7/1992 Lee ..... B63H 20/007 440/6

(Continued)

FOREIGN PATENT DOCUMENTS

KR 20180001004 U 4/2018

OTHER PUBLICATIONS

Printout from https://bixpy.com/bixpy-outboard-kit-for-kayaks/, published prior to Feb. 5, 2020.

(Continued)

*Primary Examiner* — S. Joseph Morano
*Assistant Examiner* — Jovon E Hayes
(74) *Attorney, Agent, or Firm* — Samuel M. Korte; Max M. Ali

(57) ABSTRACT

Techniques are disclosed to enable a system for controlling the propulsion and steering of a boat by a boat operator. The boat has at least one propulsion and steering motor assembly connected to the boat with a propeller, and a propulsion motor. It also has left and right pivoting pedals to provide a signal that controls the angle of the propeller so that if the left pedal is pivoted in a first pivot direction by a first percentage and the right pedal is pivoted in a second pivot direction by a second percentage, the boat executes a turn, moves forward, or moves in reverse.

16 Claims, 7 Drawing Sheets

(56) References Cited

U.S. PATENT DOCUMENTS

| | | | | |
|---|---|---|---|---|
| 6,132,267 | A * | 10/2000 | Campbell | B63H 20/007 114/364 |
| 7,575,491 | B1 * | 8/2009 | Martin | B63H 21/213 440/87 |
| 8,091,501 | B2 * | 1/2012 | Lazarevic | B63C 13/00 114/344 |
| 10,053,200 | B1 * | 8/2018 | Koetsier | B63H 20/106 |
| 10,940,923 | B2 * | 3/2021 | Langham | B63H 20/007 |
| 2007/0012236 | A1 * | 1/2007 | Caples | B63B 34/20 114/347 |
| 2010/0009579 | A1 * | 1/2010 | Wood | B63B 34/20 440/6 |
| 2019/0308709 | A1 * | 10/2019 | Kramer | B63B 32/40 |
| 2019/0337598 | A1 * | 11/2019 | Langham | B63H 20/06 |
| 2020/0247516 | A1 * | 8/2020 | Lammers-Meis | B63H 25/02 |

OTHER PUBLICATIONS

YouTube video entitled T200 Kayak uploaded by JohnB2y on Oct. 22, 2018.

* cited by examiner

BOAT STEERING AND PROPULSION SYSTEM

RELATED APPLICATIONS

The present application is a continuation of, and claims priority benefit to, co-pending and commonly assigned U.S. non-provisional patent application entitled, "BOAT STEERING AND PROPULSION SYSTEM," application Ser. No. 16/782,734, filed Feb. 5, 2020, which claims the benefit under 35 U.S.C. § 119(e) of provisional patent application entitled "KAYAK STEERING AND PROPULSION SYSTEM", Application Ser. No. 62/801,472, filed Feb. 5, 2019. Each of these earlier-filed applications are hereby incorporated by reference into the current application in their entirety.

BACKGROUND

Traditional methods of steering and propelling a boat along a body of water (e.g., lake, river, stream, etc.) typically utilize mechanical systems that propel the boat and adjust a position of a rudder mounted to the back of the boat using a lever. For instance, some conventional systems utilize a steering mechanism attached to the rudder by a cable that extends from the steering mechanism to the lever and a propulsion technique that drives an underwater propeller or paddle. Some conventional systems utilize a single assembly, such as a rotating pedal assembly, to both steer and propel the boat by providing paddle-boat type pedals where the entire assembly can be twisted from side to side to control the rudder.

SUMMARY

Techniques are disclosed to enable a system for controlling the propulsion and steering of a boat by a boat operator having left and right feet. The system includes at least one propulsion and steering motor assembly connected to the boat, the motor assembly having a propeller, and a propulsion motor. The boat also has a left foot-actuated steering control in communication with the left foot of the boat operator and having a left pivot, the left foot-actuated steering control pivoting in a first and second pivot direction to provide a left-foot control signal to control the angle or thrust of the propeller as well as a right foot-actuated steering control in communication with the right foot of the boat operator and having a right pivot, the right foot-actuated steering control pivoting in the first and second pivot direction to provide a right-foot control signal to control the angle or thrust of the propeller in connection with the left-foot control signal, wherein corresponding left and right foot signal control combinations cause boat operations including one in which pivoting left-foot steering control into the first pivot direction by a left pivot percentage and pivoting right-foot steering control into the second pivot direction by a right pivot percentage causes the boat to execute a propulsion or steering maneuver.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present technology will be apparent from the following detailed description of the embodiments and the accompanying drawing figures.

BRIEF DESCRIPTION OF THE DRAWINGS

The figures described below depict various embodiments of the present invention. It is understood that these figures depict exemplary embodiments. The exemplary features illustrated in the figures are intended to represent these aspects of the various disclosed embodiments and not intended to limit the claimed scope to any particular feature. Further, whenever possible, the following description refers to the reference numerals included in the figures, in which features depicted in multiple figures are designated with consistent reference numerals.

DETAILED DESCRIPTION

Figure 1:
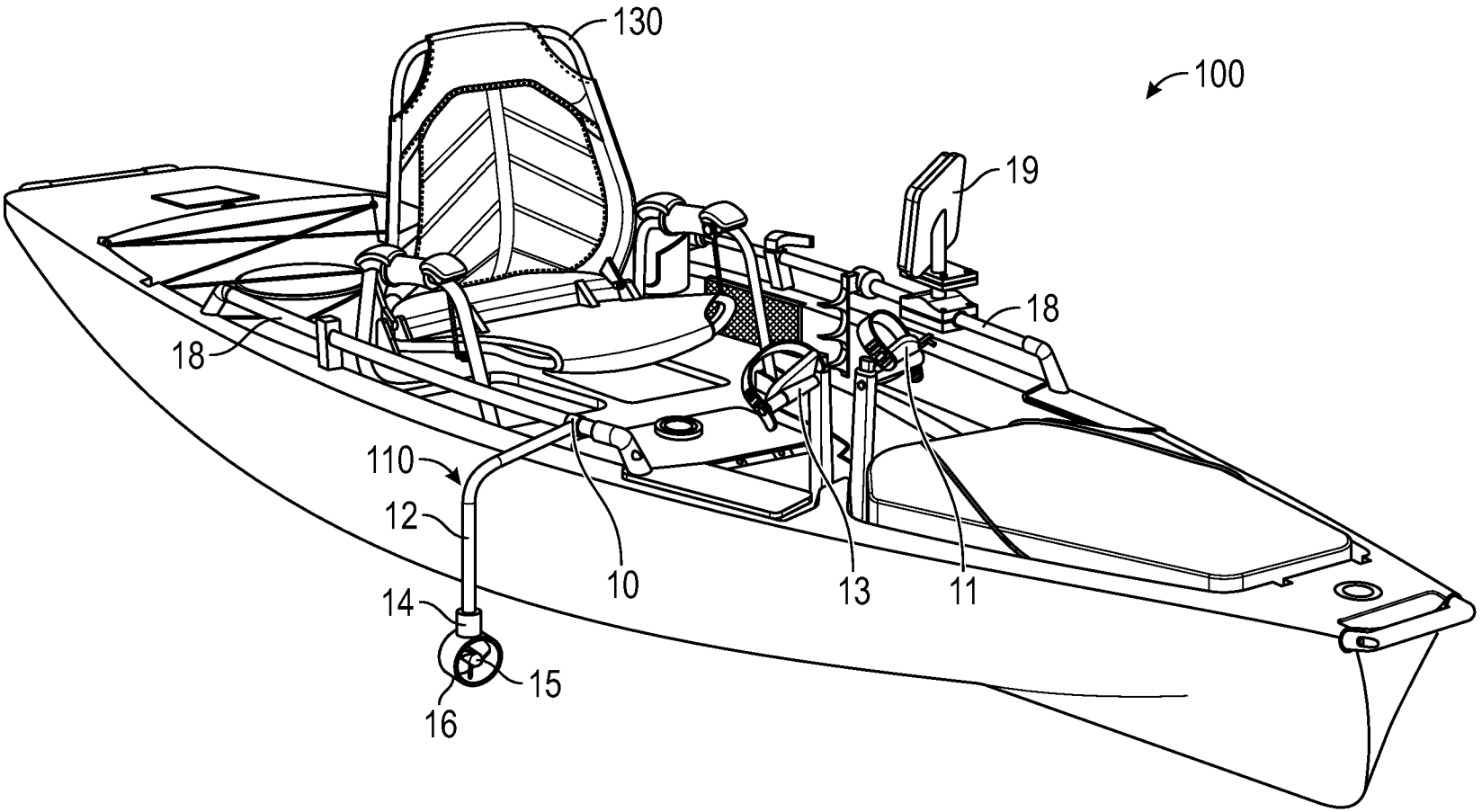
FIG. 1 is a perspective view of a kayak including a rail system to which a head unit and rotatable motors may be mounted.

The following text sets forth a detailed description of numerous different embodiments. However, it is understood that the detailed description is to be construed as exemplary only and does not describe every possible embodiment since describing every possible embodiment would be impractical. In light of the teachings and disclosures herein, numerous alternative embodiments may be implemented.

It is understood that, unless a term is expressly defined in this patent application using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent application.

The following detailed description of the technology references the accompanying drawings that illustrate specific embodiments in which the technology may be practiced. The embodiments are intended to describe aspects of the technology in sufficient detail to enable those skilled in the art to practice the technology. Other embodiments may be utilized and changes may be made without departing from the scope of the present technology. The following detailed description is, therefore, not to be taken in a limiting sense. The scope of the present technology is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology may include a variety of combinations and/or integrations of the embodiments described herein.

Embodiments of the technology apply to the field of boat propulsion and steering systems. Using propulsion and steering motor assemblies that are connected to a boat, a boat operator can guide a boat through a body of water, controlling the propulsion and steering the boat by using his or her feet. Using foot-actuated steering controls such as pedals or foot-worn motion sensors either attached to a shoe, foot mount, or pedal associated with the boat, propulsion and steering of the boat can be controlled by the boat operator.

Embodiments of the present teachings utilize a steering and propulsion system and may include one or more rotatable motors and one or more pedals or body-worn, motion sensors that are wirelessly coupled with the rotatable motors. For example, a first rotatable motor may be mounted to a port side of the kayak and a second rotatable motor may be mounted to a starboard side of the kayak. Several embodiments in the present teachings are described in connection with kayaks, which are a type of boat. It is understood that such embodiments are not limited to use in connection with kayaks but could be used in connection with any kind of boat. A motion sensor wirelessly coupled with one or both of rotatable motors may be removably secured to a hand or a foot of the user using a strap. The first and second rotatable motors may wirelessly receive and process signals output by the motion sensor. Each motor may utilize the received signals to select a direction (heading) and a speed (rotations of a propeller per second) to cause the kayak to move and be steered along the body of water as desired by the user or boat operator. In some configuration, non-rotatable motors may be employed. For instance, dual, fixed motors may be utilized with differential thrust to steer the kayak without requiring physical motor rotation. In such configurations, movement of the pedals and/or motion sensors varies the thrust provided by the motors to produce the desired steering action.

The motion sensor may include an accelerometer that identifies a direction and magnitude of acceleration associated with each movement. The steering and propulsion system may be configured to select a direction of each rotatable motor based on a determined position of the pedals or motion sensor(s). In various embodiments, the pedals are fixedly or removably mounted to a boat. For example, a motion sensor may be attached to a user's foot and the steering and propulsion system may utilize motion signals output by the motion sensor to determine in which direction to position each motor to enable the user to steer the kayak. The motion sensor may have a neutral position (e.g., the user's foot is pointing straight ahead towards the front of the kayak) and is configured to identify incremental lateral movements (to the left or the right of the neutral position). The steering and propulsion system may utilize motion signals received from the motion sensor to identify a movement in the right direction and thereby cause rotation of the motors to the right of the kayak. Similarly, the steering and propulsion system may utilize motion signals received from the motion sensor to identify a movement in the left direction and thereby cause rotation of the motors to the left of the kayak.

Additionally or alternatively, the steering and propulsion system may be configured to set the thrust of the motors to steer the kayak based on signals received from the motion sensor. The steering and propulsion system may be configured to select a speed (and therefore thrust) of each rotatable motor based on a determined position of the motion sensor. For example, the steering and propulsion system may utilize motion signals output by the motion sensor attached to the user's foot to determine in a desired speed of each motor to enable the user to propel the kayak by a desired amount. The motion sensor may have a neutral position (e.g., the user's foot is positioned at a 45-degree angle above the inner surface of the kayak) and is configured to identify incremental vertical movements (above or below the neutral position). The steering and propulsion system may utilize motion signals received from the motion sensor to identify a downward movement of the sensor associated with a desired decrease in speed and thereby cause reduction in the rotation of the motors to slow down movement of the kayak. Similarly, the steering and propulsion system may utilize motion signals received from the motion sensor to identify an upward movement of the sensor associated with a desired increase in speed and thereby cause an increase in the rotation of the motors to speed up movement of the kayak. Additionally, combinations of forward and backward pivoting of the operator's feet can be used to provide signals to the propulsion and steering motor assembly regarding a turn to execute or to propel the boat forward or in reverse.

In other embodiments, the steering and propulsion system may include a plurality of motion sensors. For example, a first motion sensor may be secured to the user's left foot and a second motion sensor may be secured to the user's right foot using straps. The steering and propulsion system may associate a motion sensor with a rotatable motor such that each rotatable motor may be independently controlled by a corresponding motion sensor. For example, the first motion sensor secured to the user's left foot may be associated with a rotatable motor mounted to a left side of the kayak and the second motion sensor secured to the user's right foot may be associated with a rotatable motor mounted to a right side of the kayak. In this way, the boat operator is able to independently select a direction and speed of each motor.

In embodiments, each rotatable motor may include a primary housing positioned below the water surface while in use, a propeller attached to the primary housing, and a rotatable shaft similar to a conventional trolling motor. Each rotatable motor may include a processor, a receiver and an antenna configured to wirelessly receive signals from a motion sensor and/or the head unit. The processor, the receiver and the antenna may be enclosed within the primary housing of the rotatable motor. In embodiments, the processor, receiver and the antenna are enclosed within a secondary housing that is positioned above the water surface while the motor is in use, which increases performance and durability of motor. In such embodiments, one or more electrical wires (enclosed in water-sealed cables) may pass from the primary housing, which is typically submerged under water, to the secondary housing, which is typically above the water surface, to pass signals between the two housings. The signals passed from the processor to the second housing include control signals identifying a selected direction and speed for the rotatable motor.

In embodiments, each motion sensor may include a housing enclosing a processor, an inertial sensor device (e.g., accelerometer, gyroscope, etc.), and a transmitter similar to a conventional foot pod, such as the Garmin™ foot pod such as Garmin part number 010-11092-00 foot pod. The foot pod may be secured to an upper surface of a shoe by using a shoelace clip through which the shoelaces are threaded. A tab may be used to release the foot pod from the lace clip. In other embodiments, the motion sensor may be fit in a mid-sole pocket of a shoe worn by the user or attached to (or within) a sole of the shoe. The motion sensor may output a current position or movement of the housing for use by the steering and propulsion system to determine a direction and speed of movement that are desired for the kayak by the user or boat operator.

In various embodiments, movement of the foot pedals or motion sensors does not necessarily directly relate to the movement of a single motor. In embodiments that employ a single propulsion motor, pushing the left foot forward, for example, results in both a rotation of the motor from straight forward and the rotation of the propeller to get the desired turning effect. If the motor is mounted forward of midship, the motor will rotate in the direction of the desired turn. If it is mounted aft of midship, it will rotate in the opposite direction.

In various embodiments, the propulsion motor is mounted on or near the back of the boat. In these embodiments, pivoting the right pedal 50% forward and the left pedal 50% backwards causes the propulsion motor to rotate 90 degrees clockwise. This will cause the boat to pirouette to the left. As further described below, in various embodiments, the turn direction is configurable such that the same pedal movements would cause the motor to rotate 90 degrees counterclockwise and cause a pirouette to the right.

In embodiments, the kayak may include a rail system to which the head unit and the rotatable motors may be mounted. Exemplary mounting systems for kayaks further described below. As further explained below, the rail system of the kayak can include lateral extensions to which the rotatable motors can be mounted. Use of such lateral extensions increases a lateral separation between a center line (extending from the front (bow) and rear (stern) of the kayak)) and the position of the rotatable motors in comparison with configurations in which the rotatable motors are mounted to rails along the sides of a kayak.

Although the technology has been described with reference to the embodiments illustrated in the attached drawing figures, it is noted that equivalents may be employed and substitutions made herein without departing from the scope of the technology as recited in the claims.

FIG. 1 is a perspective view of a kayak including a rail system to which a head unit and rotatable motors may be mounted. In various embodiments, kayak 100 is outfitted with mounting rails 18 which can be rigidly attached to or integrated into the structure of the kayak 100. In an embodiment, one or more rotatable propulsion motors 110 is attached to one or more of the mounting rails 18. In an embodiment, the propulsion motor 110 has a shaft 12 that is mounted to the rail 18 by mounting bracket 10 and that supports the motor housing 16, which encloses the propeller 15 and associated propulsion motor that drives the propeller 15. In various embodiments, a rotation motor 14 is provided to rotate the motor housing 16 in any direction so that the propulsion motor 110 can provide thrust in any direction. A kayak user or boat operator sits in seat 130 and places his or her feet into pedals 11 and 13. In various embodiments, positioning of the operator's feet in the pedals 11 and 13 provides a signal to head 19 regarding propulsion and steering operations to be performed. Wireless motion sensors (not shown) either on the shoes of the boat operator or integrated into the pedals 11 and 13 can be used to provide information regarding the position and movement of the boat operator's feet. Alternatively, rotational position sensors are integrated into the pivot points of the pedals 11 and 13 to detect an amount of pivot at the points. The rotational sensors provide a measurement of pivot angle to the propulsion and steering system to control the propulsion motor 110. The measured pivot angle information is transmitted either wirelessly or by way of wires directly or indirectly to the propulsion motor 110. In various embodiments, this pivot angle information is processed at head 19 and then either wirelessly or by way of integrated wires, appropriate control signals are transferred to the propulsion motor 110 to control propulsion and steering of the kayak 100. For example, the pivot angle information may be utilized to set the rotation angle and/or thrust of the one or more motors 110.

Figure 2:
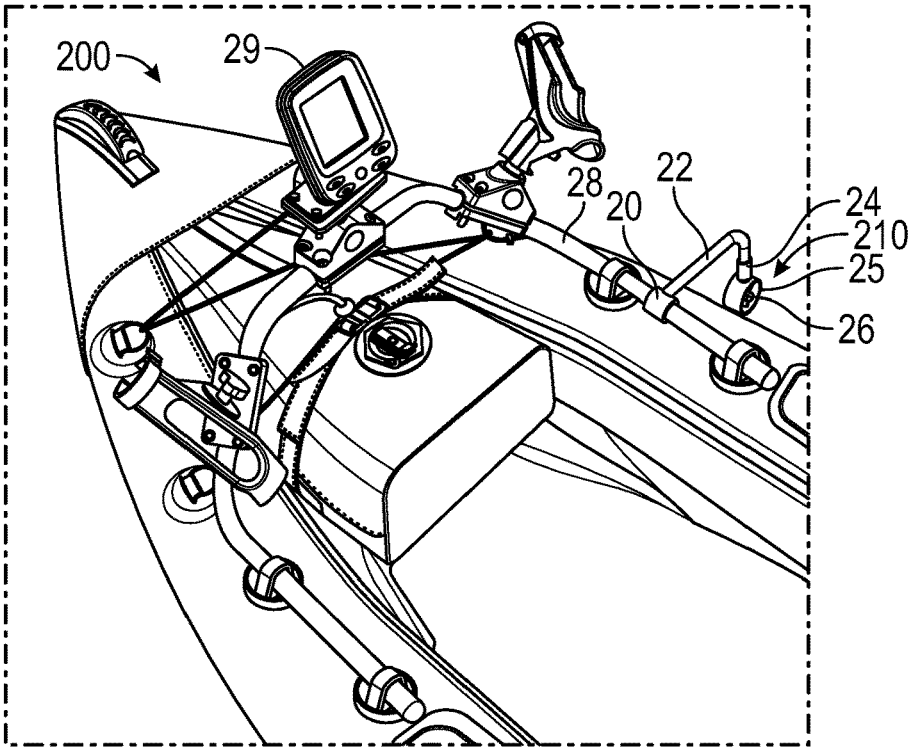
FIGS. 2 and 3 depict alternative views of a kayak with rail systems to which a head unit and rotatable motors may be mounted.
Figure 3:
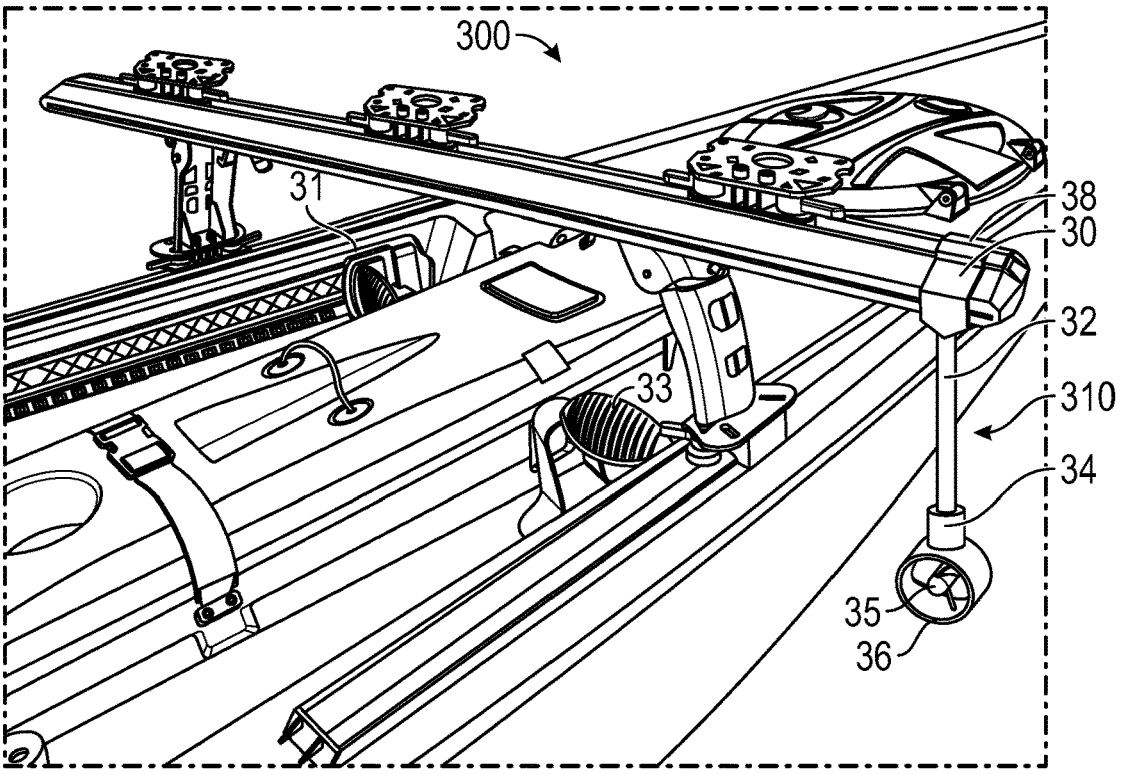

FIGS. 2 and 3 depict alternative views of kayaks 200 and 300 with rail systems to which a head unit and rotatable motors may be mounted. In FIG. 2, portions of a kayak 200 are shown to which a mounting rail 28 is affixed. In this figure, a single propulsion motor 210 is represented with a mounting bracket 20 a shaft 22 and a rotation motor 24. Motor housing 26 is provided to enclose propeller 25 and the associated propulsion motor. In various embodiments, the steering and propulsion system includes a head unit 29 including a housing, a transceiver, and a processor. In an embodiment, the head unit 29 is in communication with motion sensors (not shown) as well as the rotatable motor 210. The head unit 29 may utilize motion signals output by the motion sensors to determine and control a direction and speed for the propulsion motor 210. In various embodiments, the head unit 29 includes a display and a user interface to enable a user to view information and provide inputs to configure operation of the steering and propulsion system. In various embodiments, the housing of the head unit may include features to enable mounting of the head unit at a position above the kayak in front of the user while seated in the kayak. In FIG. 3, the alternative kayak 300 is illustrated having an alternative mounting rail 38. In an embodiment, the propulsion motor 310 is mounted to the mounting rail 38 by mounting bracket 30, which supports shaft 32. In an embodiment, rotation motor 34 is provided to rotate the motor housing 36 which itself contains the propeller 35 and associated propulsion motor. Also shown are pedals 31 and 33.

Figure 4:
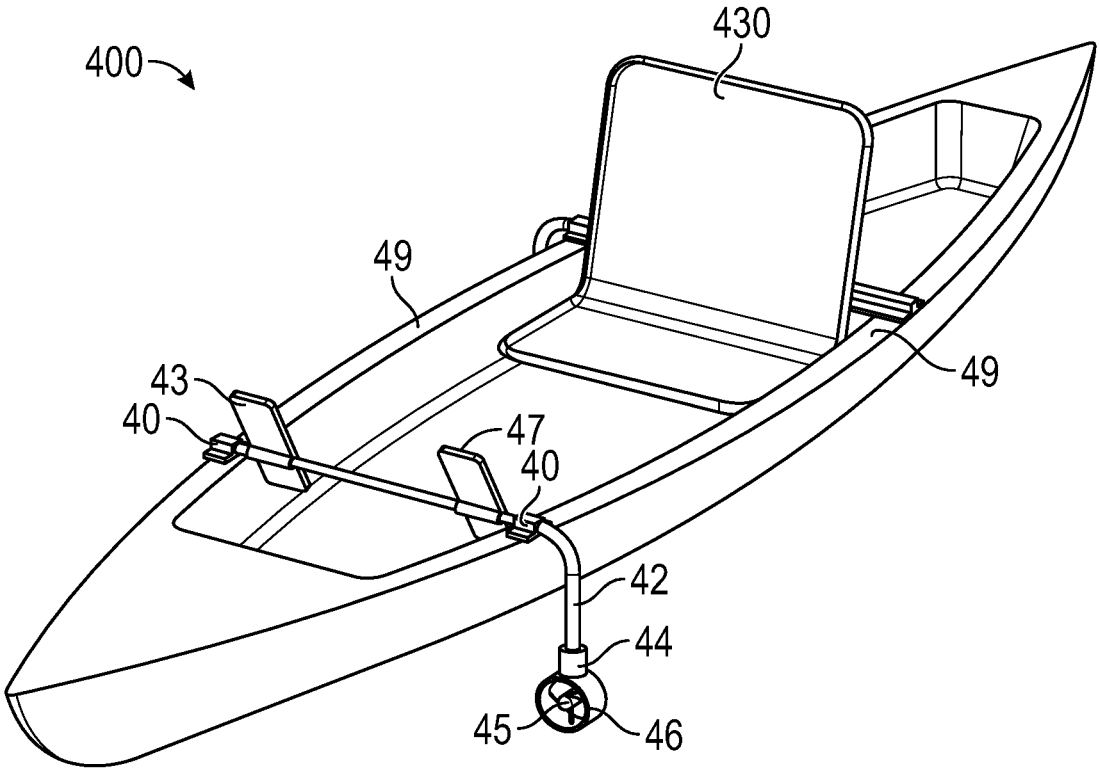
FIG. 4 is a schematic depiction of a kayak with rotatable motors mounted directly to the gunwales.

FIG. 4 is a schematic depiction of a kayak 400 with rotatable motors mounted directly to the gunwales of the kayak 400. In this embodiment, the mounting rails described in connection with the previous figures are omitted, and the mounting brackets 40 are mounted directly to gunwales 49 of the kayak 400. In this way, the shaft 42 is rigidly connected to the kayak 400. Rotation motor 44 controls the rotation of motor housing 46 which contains the propeller 45 and associated propulsion motor to control propulsion and steering of the kayak 400. As described in connection with the other figures, seat 430 is used by the kayak operator to sit in and operate the kayak.

Figure 5:
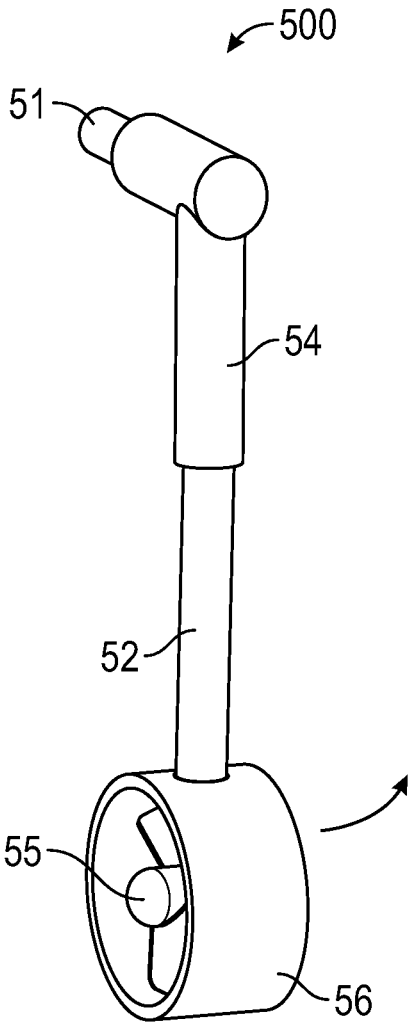
FIGS. 5 and 6 depict alternative embodiments of rotatable propulsion motors consistent with the present teachings.
Figure 6:
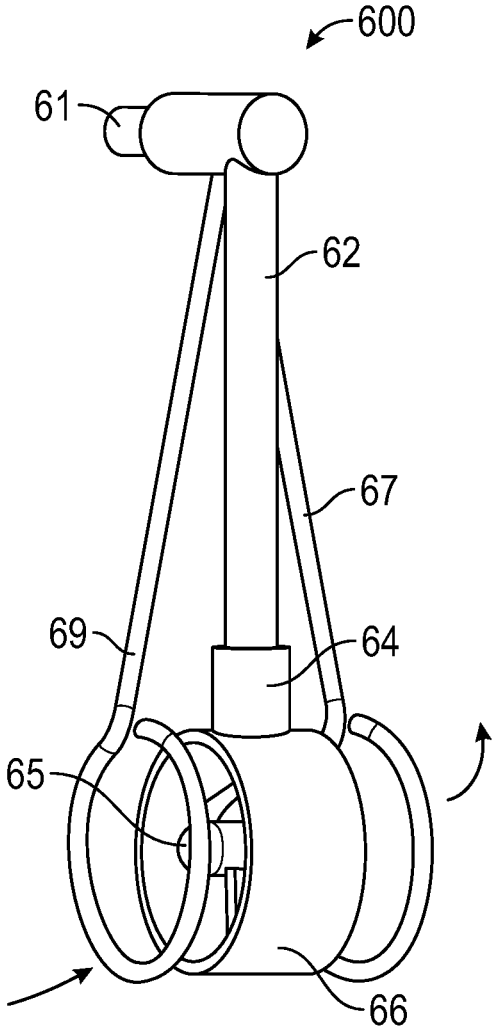

FIGS. 5 and 6 depict alternative embodiments of rotatable propulsion motors 500 and 600 consistent with the present teachings. The illustrated propulsion motors 500 and 600 rotate their associated propulsion motors at different points of the shaft. As shown in connection with FIG. 5, the propulsion motor 500 rotates shaft 52, which is rigidly attached to the motor housing 56 by way of rotation motor 54. As shown the motor housing 56 encloses and protects the propeller 55 and its associated propulsion motor. In various embodiments, spring loaded motor arm release 51 releases when the motor strikes an obstacle with sufficient force to overcome the internal release spring the motor arm release allows the motor to swing out of the way of the obstacle. The boat operator can also manually slide the release to swing the motor into the desired position, for transport of the boat, for example. By contrast, in the propulsion motor 600, the motor housing 66 is rotated by rotation motor 64 at the distal end of shaft 62. The motor housing 66 encloses and protects the propeller 65 and its associated propulsion motor. It is understood that in any alternative embodiment, the propulsion motor can be located in a remote position, driving (for example) a flexible shaft to rotate the propeller 65. Motor guards 67 and 69 are also provided as shown in the figure. When the motor guards strike an obstacle in either the forward or backward direction, the motor guard 67 or 69 releases the motor arm at release point 61 to swing freely and out of the way of the obstacle. The boat operator can also grab the motor guards 67, 69 to release and reposition the motor as needed.

Figure 7:
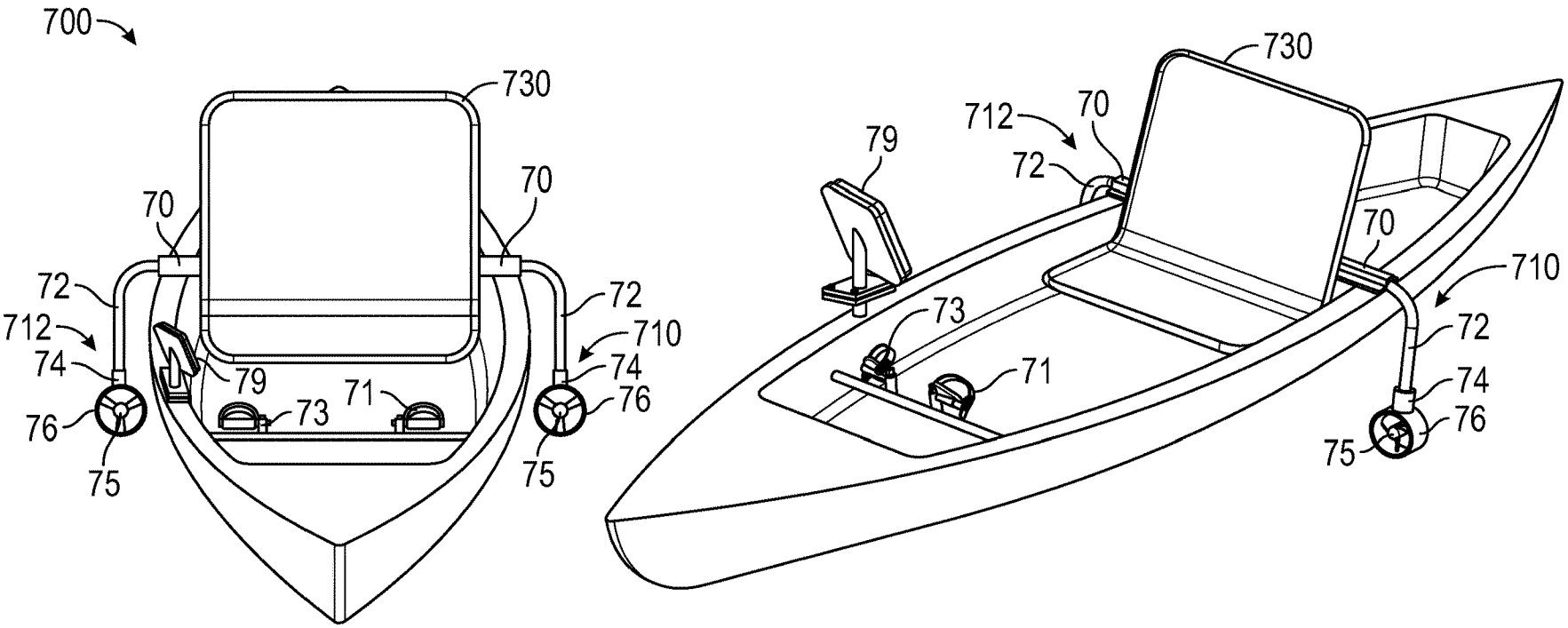
FIG. 7 is a schematic depiction of a kayak with rotatable motors mounted directly to its gunwales.

FIG. 7 is a schematic depiction of a kayak 700 with rotatable motors mounted directly to the gunwales of the kayak 700. In connection with FIG. 7 an embodiment is illustrated having two propulsion motors 710 and 712. In an embodiment, the propulsion motors 710 and 712 have shafts 72 that support the motor housings 76, which enclose the propellers 75 and associated propulsion motors that drive the propellers 75. In various embodiments, rotation motors 74 are provided to rotate the motor housings 76 in any direction so that the propulsion motors 710 and 712 can provide thrust in any direction to carry out various boat propulsion and steering maneuvers. A kayak user or boat operator sits in seat 730 and places his or her feet into pedals 71 and 73. In various embodiments, positioning of the operator's feet in the pedals 71 and 73 provides a signal to head 79 regarding propulsion and steering operations to be performed. Wireless motion sensors (not shown) either on the shoes of the boat operator or integrated into the pedals 71 and 73 can be used to provide information regarding the position and movement of the boat operator's feet. Alternatively, rotational position sensors are integrated into the pivot points of the pedals 71 and 73 to detect an amount of pivot at the points. The rotational sensors provide a measurement of pivot angle to the propulsion and steering system to control the propulsion motors 710 and 712. The measured pivot angle information is transmitted either wirelessly or by way of wires directly or indirectly to the propulsion motors 710 and 712. In various embodiments, this pivot angle information is processed at head 79 and then either wirelessly or by way of integrated wires, appropriate control signals are transferred to the propulsion motors 710 and 712 to control propulsion and steering of the kayak 700.

In this way, a foot-operated throttle/steering mechanism is provided in which the boat operator's foot pivots the pedals 71 and 72 either forward or backward with the pivot percentages being detected by pivot measurement devices such as optical coders or the rotation detectors used in devices such as scroll wheels. The foot pedals can pivot on an axis located between the toe and heel and allow the kayak operator to adjust the pedal angle at which no power is provided to the motor. The system can also allow the kayak operator to adjust the position of the foot relative to the pedal pivot.

In various configurations, multiple motors may be provided on either side of the boat, capable of operating at different speeds (thrusts), forward/reverse, and in different directions so as to propel, turn, and pirouette the boat omni-directionally. As used herein to pirouette means to rotate about a central axis without substantial positional movement in any direction other than the rotation. In various embodiments, a motor mount bracket 70 is affixed directly to the boat hull (e.g., kayak hull) via metal plates inside the hull at the gunwales and machine screws piercing the hull and screwing into the metal plates, located directly behind the paddler of a solo boat, or between paddlers of a tandem boat, approximately midships. As shown in connection with FIG. 4, one motor may be mounted forward of midships, the other motor aft of midships, in which motors can be fixed either facing parallel to the keel or perpendicular to the keel, allowing the boat to move forward and backward or sideways either direction, turning or pirouetting via differential thrust.

In various embodiments, the pedals have a pivot about mid-foot, and the pedals pivot forward and backward to control throttle and steering. In an embodiment, the "zero-throttle" angle is adjustable for the comfort and convenience of the boat operator. In an embodiment this "zero-throttle" angle is adjustable by way of the head unit 29 of FIG. 2.

In various embodiments, boats consistent with the present teachings steer in a manner similar to a zero-turn lawn mower. In various embodiments, the system is configurable to swap right vs. left turn maneuvers such that the right toe forward makes the boat turn right as opposed to left. Some examples of boat controlling pedal pivot combinations are as follows. When pivoting both toes of the pedals forward to a 100% pivot percentage position, the boat would be propelled straight ahead at full throttle. Moreover, by pivoting both toes of the pedals backward to a pivot percentage of 100% the boat will be propelled backwards at full throttle. With the left foot forward at 100% pivot percentage and the right foot forward at 75%, the boat will turn right gradually at full throttle. With the left foot forward at 75% pivot percentage and the right foot at zero, i.e. neither forward nor backward, the boat will turn more sharply to the right at 75% throttle. With the left foot forward at 50% pivot position and the right foot backward at 50% pivot position, the boat will pirouette right at 50% throttle. Such functionality may be provided, for example, by setting the rotation angle of the one or more motors based on the pedal position and/or by setting a thrust (speed) of the one or more motors based on the pedal position.

In various embodiments, a mechanism is provided that allows a motor assembly to be quickly attached or removed from the motor mount bracket (thereby detaching the motor assembly from the boat). For instance, as kayaks are intended to be easily-transported portable and lightweight watercraft, enabling the motor assembly to be quickly attached or removed facilitates stowing the kayak, lifting the kayak, and moving the kayak to and from water.

As described in connection with FIGS. 5 and 6, a quick-release mechanism can be provided allowing each motor arm to swing independently forward or backward around an axis perpendicular to the boat's keel and parallel to the water's surface. The mechanism releases when the motor or a motor guard impacts an obstacle (rock, etc.), allowing the motor arm to swing freely out of the way of the obstacle to avoid damage. The mechanism can also be manually released by the boater in order to raise the motors above the water. The mechanism will hold the motor arm in one of three fixed positions: perpendicular to the water with motors submerged, parallel to the water with motors out of the water and positioned forward of the motor mount bracket, and parallel to the water with motors out of the water and positioned behind the motor mount as further described below in connection with FIG. 8.

A mechanism can additionally or alternatively be provided that allows the motors to be set at different water depths. In various embodiments, the motors may be independently steered 360 degrees about the motor arm axis, allowing omni-directional propulsion. In various embodiments, an auto-stabilize feature is provided in which sensors detect the boat's relative angle to the water and change motor angle and thrust to counteract capsize forces and help the boat remain upright. For example, accelerometers, gyroscopes, compasses, GPS receivers, flow sensors, water sensors, and/or other attitude and position sensors may be utilized to determine the boat's relative angle to the water. One or more of these sensors may also be utilized to detect boat lean and provide power and steering to a motor or multiple motors to move the boat in the direction of the lean (similar to the Segway-type vehicle that moves forward when the operator leans forward, backward when he or she leans backward, but in all directions on the surface of the water).

Figure 8:
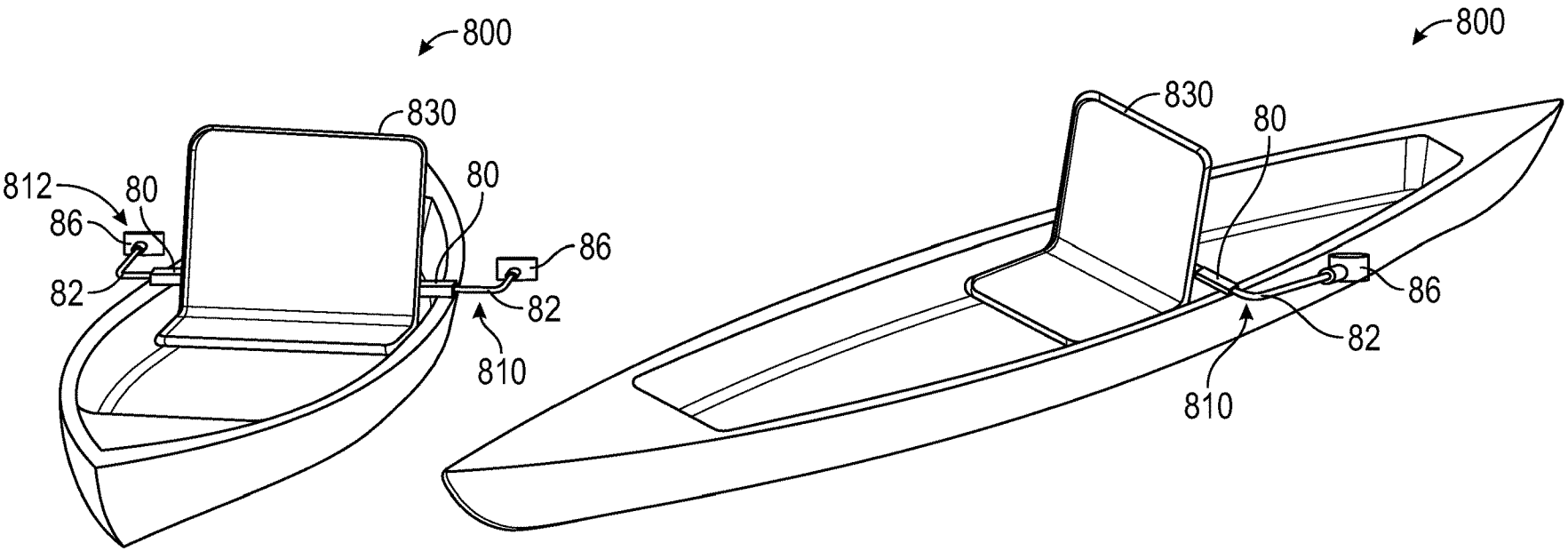
FIG. 8 is a schematic depiction of a kayak with rotatable motors mounted directly to its gunwales in a retracted position for transport.

FIG. 8 is a schematic depiction of a kayak 800 with rotatable motors mounted directly to its gunwales in a retracted position for transport. In connection with FIG. 8 an embodiment is illustrated having two propulsion motors 810 and 812 that are retracted for facilitated transport. In an embodiment, the propulsion motors 810 and 812 have mounting brackets 80 and shafts 82 that support the motor housings 86, which enclose propellers and associated propulsion motors that drive the propellers. In use. a kayak user or boat operator would be seated in seat 830.

Figure 9:
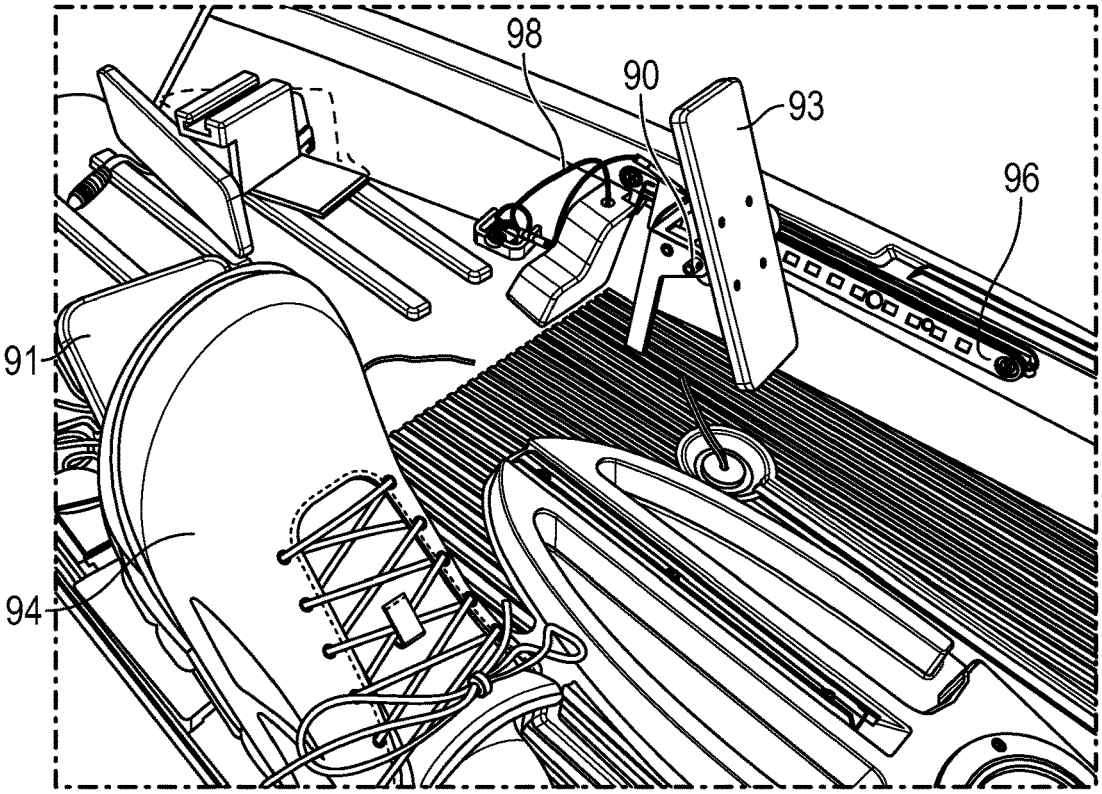
FIGS. 9 and 10 depict alternative views of pedal systems consistent with the present teachings.
Figure 10:
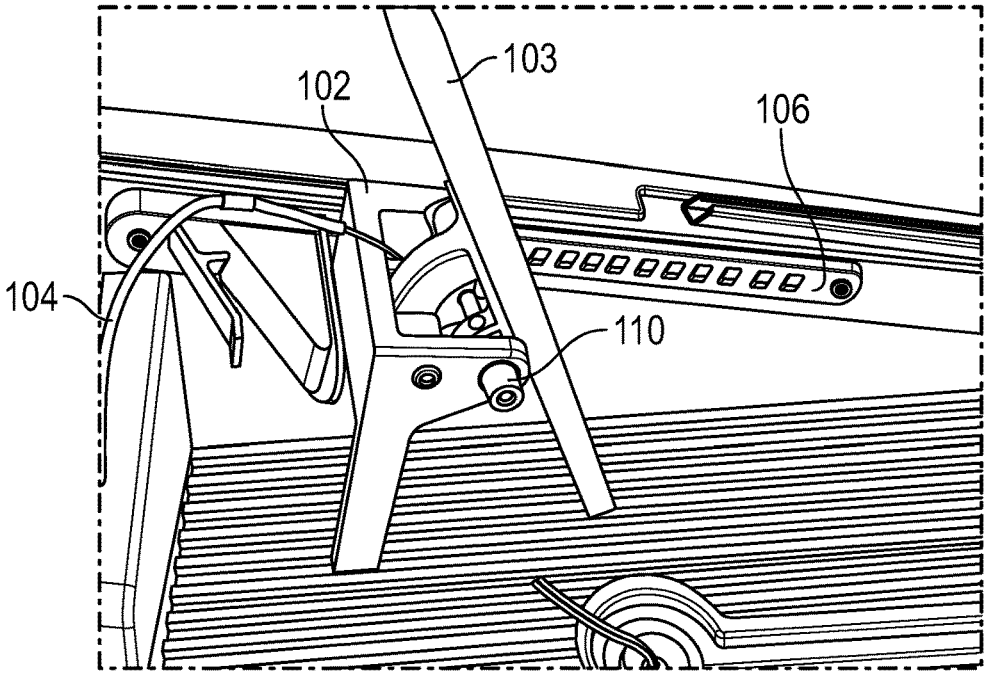

FIGS. 9 and 10 depict an alternative view of pedal systems consistent with the present teachings. In various embodiments, as illustrated in connection with FIG. 9, foot pedals 91 and 93 have a track 96 on which the pedals can be adjusted fore and aft to accommodate different leg lengths of boat operators. In various embodiments, the track 96 screw into the kayak's threaded inserts and replace the factory tracks and or foot pegs. It is understood that other mounting options are possible, like tracks that mount to the top of the gunwales, or a bar that is perpendicular to the keel and spans the gunwales and screws into them via a threaded metal plate that an installer would place inside the hollow body of a sit-on-top kayak. In various embodiments, a boat operator's shoe 94 is affixed to the pedals 91 and 93. Alternatively, conventional shoes are used by the boat operator and merely push against the pedals 91 and 93 to operate the propulsion and steering mechanism. In various embodiments, the pedals 91 and 93 pivot around pivot point 90 to generate a signal regarding a pivot distance, which can be represented by a percentage of full pivot in the forward or backward direction, i.e. the pivot direction. In an embodiment, measurement of the pivot percentage is performed by a device such as an optical encoder that measures an amount of rotation about an axis and transmitted by way of wire 98. It us understood that the measured pivot percentage can be transmitted wirelessly or via wires and is further processed as set forth above in connection with the present teachings.

Regarding FIG. 10, which illustrates how pedal 103 can be mounted via bracket 102 in track 106 and adjusted according to the leg length of a boat operator. The pedal 103 pivots about pivot point 110 and as described in connection with FIG. 9 may provide information regarding a pivot percentage by way of wire 104.

Having thus described various embodiments of the technology, what is claimed as new and desired to be protected by Letters Patent includes the following:

1. A system for controlling the propulsion and steering of a boat by a boat operator having left and right feet, the system comprising:

a propulsion and steering motor assembly connected to the boat, the motor assembly having a single motor;

a left foot-actuated steering control in communication with the left foot of the boat operator and having a left pivot, the left foot-actuated steering control pivoting in a first and second pivot direction to provide a left-foot control signal;

a right foot-actuated steering control in communication with the right foot of the boat operator and having a right pivot, the right foot-actuated steering control pivoting in the first and second pivot direction to provide a right-foot control signal, and a processor in communication with the left and right foot-actuated steering controls, the processor configured to— receive the left-foot control signal from the left foot-actuated steering control, receive the right-foot control signal from the right foot-actuated steering control, utilize the left-foot control signal and the right-foot control signal to calculate a control command for the single motor, the control command corresponding to a direction and a speed for the single motor, and provide the control signal to the single motor;

wherein corresponding left and right foot signal control combinations enable the boat operator to control the boat by pivoting the left foot in a first pivot direction by a left pivot percentage and pivoting the right foot in a second pivot direction by a right pivot percentage.

2. The system of claim 1, wherein the left pivot percentage is 100% forward, the right pivot percentage is 100% forward, and the boat is propelled straight-ahead at full throttle.

3. The system of claim 1, wherein the left pivot percentage is 100% backwards, the right pivot percentage is 100% backwards, and the boat is propelled rearwards at full throttle.

4. The system of claim 1, wherein a combination of the left and right pivot percentages causes the boat to turn in a turning direction.

5. The system of claim 4, wherein the first and second pivot directions are forward and aft respectively.

6. The system of claim 5, wherein the left pivot percentage is 100% forward, the right pivot percentage is 75% forward, the turn is at a first rate, and the turning direction is right.

7. The system of claim 5, wherein the left pivot percentage is 75% forward, the right pivot percentage is 0%, the turn is at a second rate, greater than the first rate, and the turning direction is right.

8. The system of claim 1, wherein the left pivot percentage is forward 50%, the right pivot percentage is backward 50%, the turn is a pirouette, and the turning direction is right.

9. The system of claim 1, wherein the left foot-actuated steering control includes a first foot pedal and the right foot-actuated steering control includes a second foot pedal.

10. A system for controlling the propulsion and steering of a boat by a boat operator having left and right feet, the system comprising:

a propulsion and steering motor assembly connected to the boat, the motor assembly having a single motor;

a left foot-actuated foot pedal in communication with the left foot of the boat operator and having a left pivot, the left foot-actuated foot pedal pivoting in a first and second pivot direction to provide a left-foot control signal;

a right foot-actuated foot pedal in communication with the right foot of the boat operator and having a right pivot, the right foot-actuated foot pedal pivoting in the first and second pivot direction to provide a right-foot control signal, and a processor in communication with the left and right foot-actuated foot pedals, the processor configured to— receive the left-foot control signal from the left foot-actuated foot pedal, receive the right-foot control signal from the right foot-actuated foot pedal, utilize the left-foot control signal and the right-foot control signal to calculate a control command for the single motor, the control command corresponding to a direction and a speed for the single motor, and provide the control signal to the single motor;

wherein corresponding left and right foot signal control combinations enable the boat operator to control the boat by pivoting the left foot in a first pivot direction by a left pivot percentage and pivoting the right foot in a second pivot direction by a right pivot percentage.

11. The system of claim 10, wherein the left pivot percentage is 100% forward, the right pivot percentage is 100% forward, and the boat is propelled straight-ahead at full throttle.

12. The system of claim 10, wherein the left pivot percentage is 100% backwards, the right pivot percentage is 100% backwards, and the boat is propelled rearwards at full throttle.

13. The system of claim 10, wherein a combination of the left and right pivot percentages causes the boat to turn in a turning direction.

14. The system of claim 13, wherein the first and second pivot directions are forward and aft respectively.

15. The system of claim 14, wherein the left pivot percentage is 100% forward, the right pivot percentage is 75% forward, the turn is at a first rate, and the turning direction is right.

16. The system of claim 10, wherein the processor is integrated with the motor.

* * * * *